United States Patent [19]

Fujii et al.

[11] 4,439,750

[45] Mar. 27, 1984

[54] ARMATURE HOLDING STRUCTURE AND HINGE WIRE SPRING USED THEREIN

[75] Inventors: Kunihisa Fujii, Saku; Noboru Tomono, Usudamachi; Yukio Shikano, Saku, all of Japan

[73] Assignee: Takamisawa Electric Co., Ltd., Tokyo, Japan

[21] Appl. No.: 370,038

[22] Filed: Apr. 20, 1982

[30] Foreign Application Priority Data

Apr. 21, 1981 [JP] Japan ..... 56-56634[U]

[51] Int. Cl.[3] ..... H01F 7/08; H01F 7/13

[52] U.S. Cl. ..... 335/274

[58] Field of Search ..... 335/274, 275, 276

[56] References Cited

U.S. PATENT DOCUMENTS 3,239,727 3/1966 Zupa ..... 335/274

FOREIGN PATENT DOCUMENTS 51-81933 6/1976 Japan .
52-62844 5/1977 Japan .
53-89541 7/1978 Japan .

*Primary Examiner*—Harold Broome
*Attorney, Agent, or Firm*—Armstrong, Nikaido, Marmelstein & Kubovcik

[57] ABSTRACT

An armature holding structure using a hinge wire spring in an electromagnetic relay, wherein one end of the hinge wire spring is held in a hole in the yoke of the electromagnet and the other end of the hinge wire spring is held in the hole in the armature so that the pivot support structure of the armature at the end of the yoke is maintained by the hinge wire spring.

2 Claims, 9 Drawing Figures

ARMATURE HOLDING STRUCTURE AND HINGE WIRE SPRING USED THEREIN

The present invention relates to an armature holding structure using a hinge wire spring in an electromagnetic relay and the hinge used in such an armature holding structure.

BACKGROUND OF THE INVENTION

In an electromagnetic relay of a relatively small size, for example 32×35×32 mm, an armature holding structure is used in order to support an armature rotatably on one end portion of the yoke of the electromagnet.

Examples of the prior art armature holding structure in an electromagnetic relay are illustrated in FIGS. 1A, 1B, 2A and 2B. In the structures of FIGS. 1A, 1B, 2A and 2B, the armature 2', having a rectangular aperture 23' and a groove 22', rides on one end of the yoke 13', having a rectangular aperture 132', of the electromagnet 1'. In order to maintain the pivot relationship between the armature 2' and the yoke 13', a hinge plate spring 3' having the ends partly rolled under (FIGS. 1A, 1B) or a hinge plate spring 3" having several bent portions (FIGS. 2A, 2B) bridges the groove 22' in the armature 2' and the rectangular aperture 132' of the yoke 13'. Such hinge plate spring 3' or 3" is manufactured by the process of punching a planar plate having a predetermined size from a sheet and then working such punched planar plate to give either a shape in which the ends are partly rolled under (FIGS. 1A, 1B) or a shape having several bent portions (FIGS. 2A, 2B).

However, there are problems in the structure and the manufacturing process of the devices of FIGS. 1A, 1B, 2A and 2B. First, the provision of the rectangular apertures 23' and 132' in the armature 2' and the yoke 13' causes each of the magnetic flux paths through the armature 2' and through the yoke 13' to become narrow, and hence the magnetic reluctances of the armature 2' and the yoke 13' are increased, and hence the magnetic efficiency of the magnetic path of the electromagnet 1' is deteriorated. If such deterioration of the magnetic efficiency is not desirable, the entire size of the electromagnet must be increased, which does not comply with the requirement for the reduction of the size of the electromagnetic relay.

Second, the process of attaching the hinge plate spring 3' or 3" to the groove 22' and the rectangular aperture 132' requires specially skillful work, without which the preliminarily given shape and the preliminarily stored resilient force of the hinge plate spring 3' or 3" are apt to be deviated so that uniformity of the operating characteristics of the produced electromagnetic relays cannot be achieved.

Third, in the case where the hinge plate spring 3' or 3" is manufactured by the process of punching a planar plate from a sheet having a large size in the longitudinal direction, which sheet has been manufactured by the rolling process, the degree of utilization of the sheet as a material for such punched planar plate cannot be increased. This is because the punching of the planar plate should be carried out so that the longitudinal direction of the hinge plate spring coincides with the longitudinal direction of the sheet in order to ensure the metallurgical strength of the hinge plate spring.

The structure of FIGS. 2A, 2B is disclosed in Japanese utility model application laid-open No. 53-89541.

SUMMARY OF THE INVENTION

It is the main object of the present invention to provide an improved armature holding structure and a hinge usuful for such armature holding structure, to achieve a reliable holding of the armature on the yoke, without deteriorating the magnetic efficiency, by using a relatively simple and low-cost structure, eliminating the above described disadvantages in the prior art structures.

According to an aspect of the present invention, there is provided an armature holding structure using a hinge wire spring in an electromagnetic relay comprising a base block having a shelf formed perpendicular to said base block, an electromagnet having a core, a coil and a yoke, an armature and a hinge wire spring coupled to both said yoke and said armature, said yoke being fixed to said shelf, a groove being formed in said shelf, wherein one end of said hinge wire spring is held in a hole in said yoke, the other end of said hinge wire spring is held in a hole in said armature, and the intermediate portion of said hinge wire spring passes through said groove in said shelf, along the side surfaces of said shelf, said yoke and said armature and over the outer surface of said armature, whereby the pivot support structure of said armature at the end of said yoke is maintained by said hinge wire spring.

According to another aspect of the present invention, there is provided a hinge wire spring for use in an armature holding structure in an electromagnetic relay consisting of first, second, third, fourth and fifth portions, each of the first through fifth portions being arranged to form a predetermined angle with respect to the adjacent portion, the first and the fifth portions being adapted to be inserted into the holes in a yoke of an electromagnet and said armature of said electromagnetic relay, respectively, the second and the fourth portions lying in the same plane, whereby the resilient force stored in said hinge wire spring can be used for maintaining the pivot support structure of said first and said second members of said electromagnetic relay.

DESCRIPTION OF THE PREFERRED EMBODIMENTS

Figure 1A:
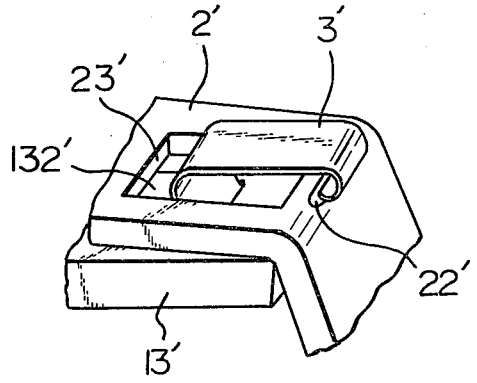
Fig. 1A PRIOR ART
FIGS. 1A, 1B, 2A and 2B illustrate two examples of the prior art structure of an electromagnetic relay.
Figure 1B:
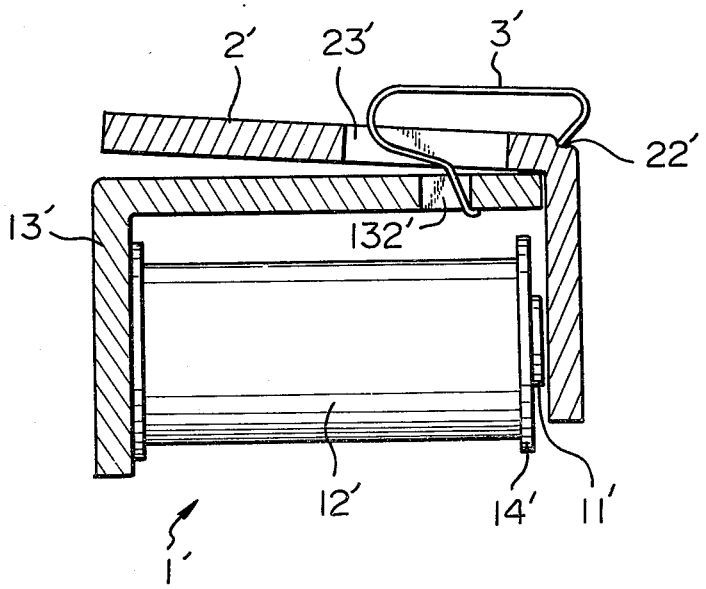
Fig. 1B PRIOR ART
Figure 2A:
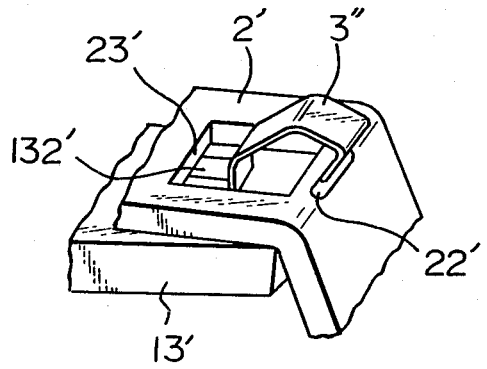
Fig. 2A PRIOR ART
Figure 2B:
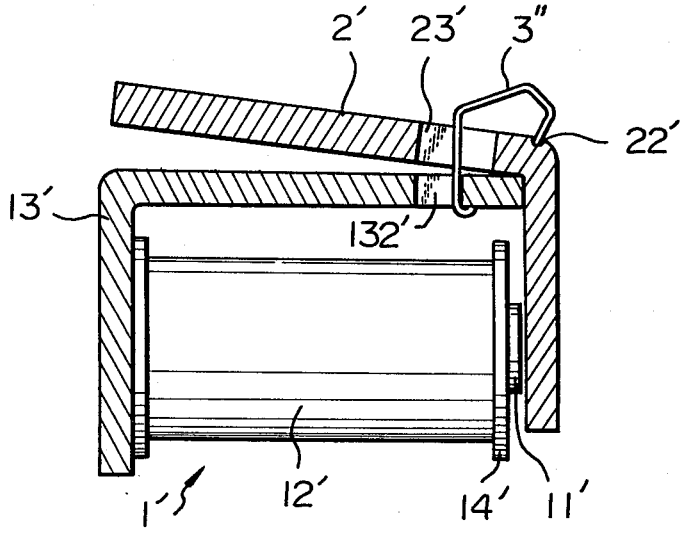
Fig. 2B PRIOR ART
Figure 3:
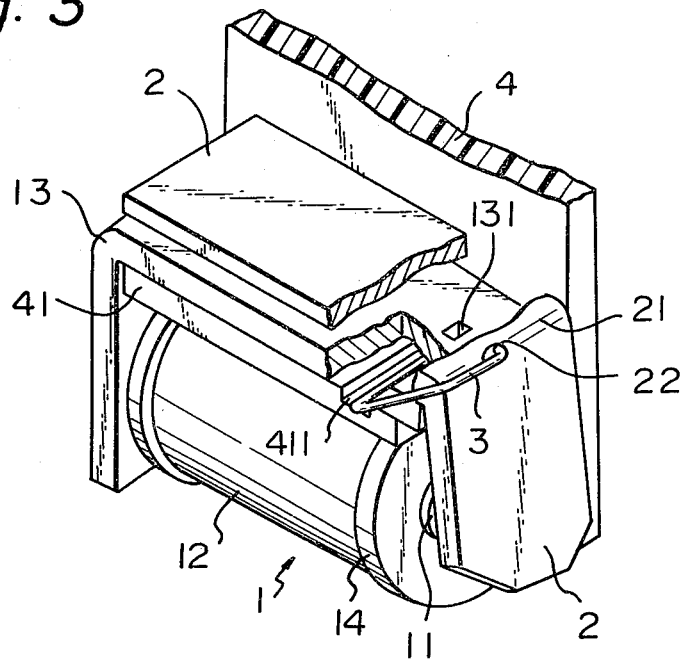
FIG. 3 illustrates a perspective view of the electromagnetic relay having the armature holding structure according to an embodiment of the present invention.
Figure 4:
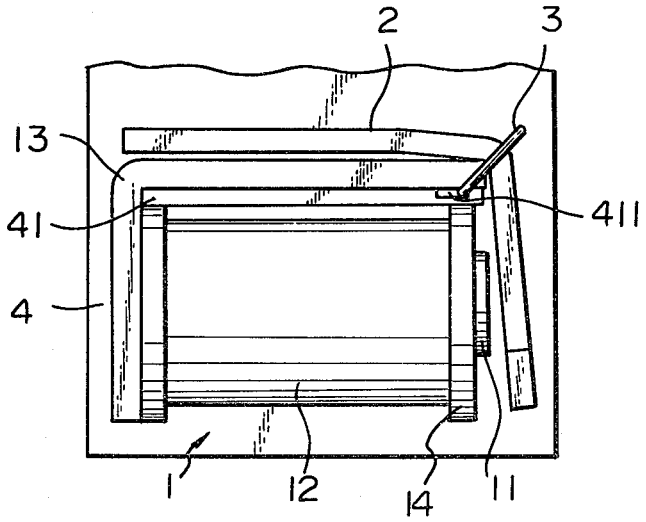
FIG. 4 illustrates the front view of the electromagnetic relay of FIG. 3.
Figure 5:
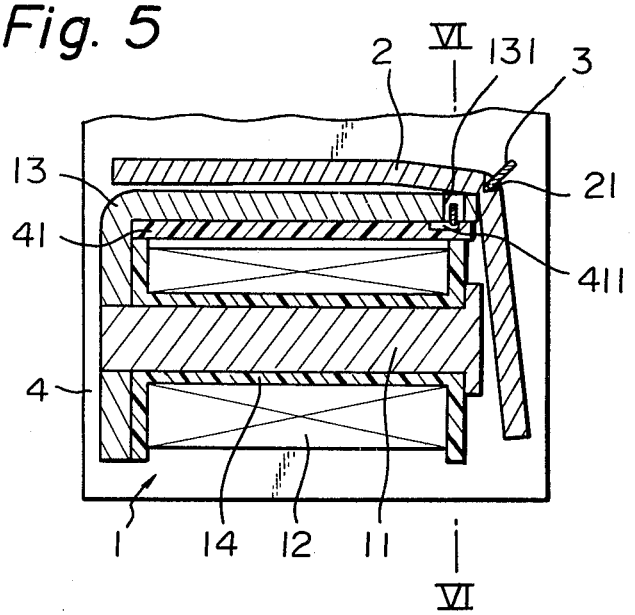
FIG. 5 illustrates the longitudinal cross-section of the electromagnet in the device of FIG. 3.
Figure 6:
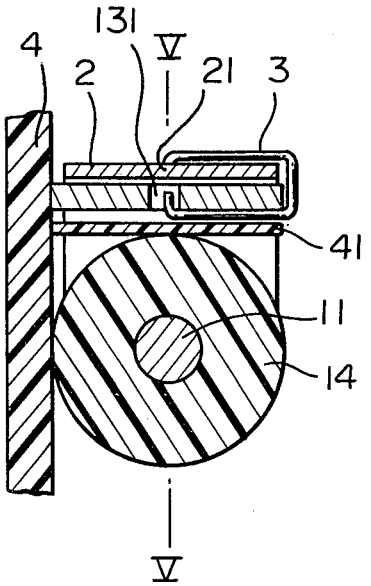
FIG. 6 illustrates the lateral cross-section of the electromagnet in the device of FIG. 3.

An electromagnetic relay using a hinge wire spring for holding an armature in accordance with an embodiment of the present invention is illustrated in a perspective view in FIG. 3. The detailed structures of the device of FIG. 3 are illustrated in FIGS. 4, 5, 6 and 7.

The important portion of the device of FIG. 3 comprises an electromagnet 1 consisting of a core 11, a coil 12, a bobbin 14, a yoke 13, an armature 2, a hinge wire spring 3 and a base block 4 having a shelf 41 projected from the base block 4. Although not shown in the drawing, other elements of the electromagnetic relay are provided, such as a card, a movable contact spring, a fixed contact spring and a restoring spring to form a complete assembly of the elements of the electromagnetic relay. The motion of the armature 2 causes, via the card, the movement of the movable contact spring to cause the movable contact to come in contact with the fixed contact. Such complete assembly of the elements is encased in a housing consisting of the base block 4 and a cover (not shown).

The yoke 13 of the electromagnet 1 is fixed to the base block 4. The shelf 41 is provided for determining the position of the electromagnet 1 with respect to the base block 4. The armature 2 is pivoted at the inner corner thereof on the edge of the yoke 13. In order to maintain such a pivot support relationship between the armature 2 and the yoke 13, the hinge wire spring 3 is provided to combine the armature 2 and the end portion of the yoke 13.

Figure 7:
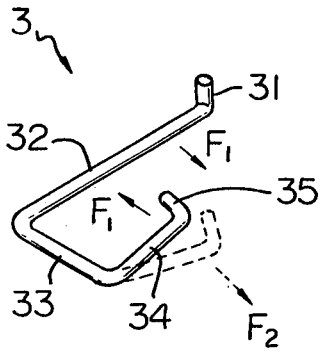
FIG. 7 illustrates a perspective view of the hinge wire spring used in an embodiment of the present invention.

The hinge wire spring 3 consists of the first 31, the second 32, the third 33, the fourth 34 and the fifth portion 35. The first portion 31 is held in the hole 131 in the yoke 13. The second portion 32 is held in the groove 411 in the shelf 41. The third portion 33 lies on the side surfaces of the shelf 41, the yoke 13 and the armature 2. The fourth portion 34 lies along the ridge 21 of the armature 2. The fifth portion 35 is held in the hole 22 in the ridge 21 of the armature 2. The hinge wire spring 3 is made of, for example, stainless steel. The shape of the hinge wire spring 3 is as shown in FIG. 7, wherein the second portion 32, the third portion 33, the fourth portion 34, and the fifth portion 35 lie in the same plane. The fifth portion 35 is approximately perpendicular to the second portion 32. After the force $F_2$ is applied to the fourth and the fifth portions 34, 35 so as to deviate the fourth and the fifth portions 34, 35 outwardly with respect to the first and the second portions 31, 32, the resilient force $F_1$ which is exerted in the direction parallel to the direction of the third portion 33, causes the fourth and the fifth portions 34, 35 to be pressed inwardly toward the second portion 32. This resilient force $F_1$ acts as a combining force between the ridge 21 of the armature 2 and the end portion of the yoke 13.

The process in which the hinge wire spring 3 is attached to the pivot structure between the armature 2 and the yoke 13 will be described below. First, the armature 2 is mounted at the inner corner thereof on the edge of the yoke 13. Then, the first and the second portions 31, 32 are inserted into the groove 411 in the shelf 41 until the first portion 31 is inserted into the hole 131 in the yoke 13. After the first and the second portions 31, 32 are inserted into the groove 411, the third portion 33 is moved clockwisely along the side surfaces of the shelf 41, the yoke 13 and the armature 2, with the fourth and the fifth portions 34, 35 being simultaneously pressed outwardly by the force $F_2$, thereby enabling the fourth and the fifth portions 34, 35 to go over the ridge 21 of the armature 21, until finally the fifth portion 34 is inserted into the hole 22 in the armature 2. Thus, the resilient force $F_1$ maintains the pivot relationship between the armature 2 and the yoke 13.

In the structure of FIG. 3 using the hinge wire spring 3, the magnetic efficiency of the magnetic path of the electromagnet 1 is maintained satisfactorily. When the hinge wire spring 3 is manufactured by the process of cutting a wire material, the degree of utilization of the wire material is a satisfactory one, because fundamentally no waste occurs in such cutting of the wire material.

Although a preferred embodiment was described hereinbefore, various modifications are possible within the scope of the present invention. For example, although a groove 411 is provided in the shelf 41 in the embodiment of FIG. 3, it is possible to provide a groove in the inner surface of the yoke 13; also it is possible to provide grooves in both the shelf 41 and the yoke 13.

We claim:

1. An armature holding structure using a hinge wire spring in an electromagnetic relay comprising a base block having a shelf formed perpendicular to said base block, an electromagnet having a core, a coil and a yoke, an armature and a hinge wire spring coupled to both said yoke and said armature, said yoke being fixed to said base block, a groove being formed in said shelf, wherein one end of said hinge wire spring is held in a hole in said yoke, the other end of said hinge wire spring is held in a hole in said armature, and the intermediate portion of said hinge wire spring passes through said groove in said shelf, along the side surfaces of said shelf, said yoke and said armature and over the outer surface of said armature, whereby the pivot support structure of said armature at the end of said yoke is maintained by said hinge wire spring.

2. A hinge wire spring for use in an armature holding structure in an electromagnetic relay, said electromagnetic relay including an electromagnet having a yoke and an armature pivotally supported on said yoke, said yoke and said armature being formed with holes therein adjacent said pivot, said hinge wire spring consisting of first, second, third, fourth and fifth portions, each of the first through fifth portions being arranged to form a predetermined angle with respect to the adjacent portion, the first and the fifth portions being adapted to be inserted into the holes in said yoke and said armature of said electromagnetic relay, respectively, the second, the third, the fourth, and the fifth portions lying in the same plane, the fifth portion being approximately perpendicular to the second portion, a resilient force being exerted in the direction parallel to the direction of the third portion after a force is applied to the fourth and the fifth portion outwardly with respect to the first and the second portion whereby the resilient force stored in said hinge wire spring can be used for maintaining the pivot support structure of said yoke and said armature.

* * * * *